US007242151B2

(12) United States Patent
Chan et al.

(10) Patent No.: US 7,242,151 B2
(45) Date of Patent: Jul. 10, 2007

(54) MULTIPLE LAMP BALANCE TRANSFORMER AND DRIVE CIRCUIT

(75) Inventors: Chun-Kong Chan, Hsi Chih (TW); Jeng-Shong Wang, Hsin Chuang (TW)

(73) Assignee: Lien Chang Electronic Enterprise Co., Ltd., Taipei County (TW)

( * ) Notice: Subject to any disclaimer, the term of this patent is extended or adjusted under 35 U.S.C. 154(b) by 225 days.

(21) Appl. No.: 11/168,512

(22) Filed: Jun. 29, 2005

(65) Prior Publication Data

US 2007/0001621 A1 Jan. 4, 2007

(51) Int. Cl.
*H05B 41/26* (2006.01)

(52) U.S. Cl. ..... 315/278; 315/282; 315/274; 315/312

(58) Field of Classification Search ..... 315/276–278, 315/274, 282, 312, DIG. 2, 224, 291; 345/102, 345/87, 84, 55, 30; 349/70, 61, 56
See application file for complete search history.

(56) References Cited

U.S. PATENT DOCUMENTS 6,717,371 B2 * 4/2004 Klier et al. ..... 315/276
6,717,372 B2 * 4/2004 Lin et al. ..... 315/282
7,075,248 B2 * 7/2006 Hsieh et al. ..... 315/277
7,190,123 B2 * 3/2007 Lee ..... 315/276

* cited by examiner

*Primary Examiner*—Tuyet Vo
*Assistant Examiner*—Ephrem Alemu
(74) *Attorney, Agent, or Firm*—Rosenberg, Klein & Lee

(57) ABSTRACT

The invention describes a multiple lamp balance transformer and a drive circuit. The multiple lamp balance transformer has two magnetic cores with a closed magnetic flux path and two coils wound around the closed magnetic flux path. The two coils have the same number of windings. The impedance property of the coil and Lenz's Law are used to balance the operating current of the lamps connected to the coils. The drive circuit has a multiple lamp balance transformer connected to several lamps, and a boost transformer uses a controller to supply the current and voltage to the lamps. A current detect/protect circuit connected to the coils and the controller detects the current passing through the coils and converts the operating current of the lamp into a voltage to be sent to the controller, so that the controller controls and provides sufficient power to the lamps.

19 Claims, 5 Drawing Sheets

MULTIPLE LAMP BALANCE TRANSFORMER AND DRIVE CIRCUIT

BACKGROUND OF THE INVENTION

1. Field of the Invention

The present invention relates to a multiple lamp balance transformer and a drive circuit, and more particularly to a transformer and a drive circuit used in a lamp equalizing circuit of a cold cathode fluorescent lamp (CCFL).

2. Description of Related Art

A cold cathode fluorescent lamp (CCFL) is generally used as a light source of a backlight module for liquid crystal display (LCD) panels. The CCFL is driven by a drive circuit of an inverter. Due to technological advancements and consumer requirements, the size of an LCD panel becomes increasingly larger and a single lamp no longer satisfies the illumination requirements thereof. Therefore, two or more lamps are needed. To assure an even brightness for the LCD panels, it is necessary to adjust the current of each lamp constantly, so that the current passing through each lamp is equal. Since the height of the CCFL varies and the CCFL has negative impedance, it is difficult to maintain consistent impedance for all lamps. As a result, the impedance of each lamp varies and the current cannot be equalized. If the currents between the lamps are not equal, the brightness will be uneven. An excessively large current will shorten the life of the lamps, and will result in a different aging rate of each lamp.

Reference is made to FIG. 1, which is a circuit diagram for using two independent balance transformers to balance the current of four CCFLs. In FIG. 1, a controller 10 supplies currents I1, I2, I3, I4 with a voltage required by a lamps L1, L2, L3, L4 through a boost transformer Tr to emit light. By adopting the impedance of the coil of a balance transformer as well as following Lenz's law, the operating currents passing through the lamps and the coils are balanced. If the currents I1, I2, I3, I4 are equal, the currents passing through each coil of the balance transformers T1, T2 are equal. Thus, the magnetic motive forces produced separately by the currents I1, I2 at the coil of the balance transformer T1 and the currents I3, I4 at the coil of the balance transformer T2 are equal and these magnetic motive forces cancel each other. As a result, there will be no magnetic flux between the balance transformers T1, T2. The leakage flux produced in each of the balance transformers T1, T2 passes through an air gap on the external side to complete a circuit. Since the magnetic resistance of the air gap is very high, the inductance effect caused by this circuit is negligible.

Further, a voltage detect/protect circuit 20 picks up the operating currents I1, I2, I3, I4 of the lamps and converts these operating currents I1, I2, I3, I4 into a voltage to be sent to the controller 10. The controller will then control and adjust the power output and supply the required voltage to the operating currents I1, I2, I3, I4 for emitting light currents according to an error signal.

However, only the currents I1, I2 or the currents I3, I4 of the prior art can be balanced independently, and the quantity of balance transformers used is increased according to the increase of the quantity of lamps. From FIG. 1, if it is necessary to drive four lamps, then two balance transformers T1, T2 are needed. Such arrangement not only increases the size of the whole drive circuit, but also increases the cost thereof, and wastes manpower and working hours for assembly.

SUMMARY OF THE INVENTION

In view of the shortcomings of the prior art, the present invention provides a multiple lamp balance transformer and a drive circuit. A balance transformer has two closed magnetic flux paths, and each closed magnetic flux path is wound with two windings. The number of windings for the coils is equal. The impedance property of a coil and Lenz's Law are adopted to balance the operating currents of the lamps connected to the coils.

The multiple lamp balance transformer of the invention is connected to a plurality of lamps and used for balancing the operating current of the multiple lamps. The multiple lamp balance transformer comprises a magnetic core including a first side post, a second side post, and a middle post disposed between the first side post and the second side post. The middle post forms two closed magnetic flux paths with the first side post and the second side post, respectively; two first coils are wound around the first side post in opposite directions, and two second coils are wound around the second side post in opposite directions. The number of windings of the two first coils is equal to the number of windings of the two second coils, and the impedance property of the coils and Lenz's Law are used to balance the operating current passing through the lamps and coils.

The drive circuit of the multiple lamp balance transformer in accordance with the present invention adopts the foregoing multiple lamp balance transformer connected to a plurality of lamps while using a controller that supplies currents to the lamps through a boost transformer. A current detect/protect circuit connected to the two first coils, the two second coils and the controller are used to detect the current passing through the two first coils and the two second coils. The current detect/protect circuit converts the operating current of the lamps into a voltage to be sent to the controller, so that the controller controls and supplies sufficient power for the lamps.

The drive circuit of the invention adopts a multiple lamp balance transformer to balance the plurality of lamps, so that the size of the drive circuit is smaller than that of the prior art. At the same time, the cost of the invention can be lowered, and the manpower and working hours for assembly can be reduced to enhance product competitiveness.

To make it easier for our examiner to understand the innovative features and technical content, we use a preferred embodiment together with the attached drawings for the detailed description of the invention, but it should be pointed out that the attached drawings are provided for reference and description but not for limiting the present invention.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
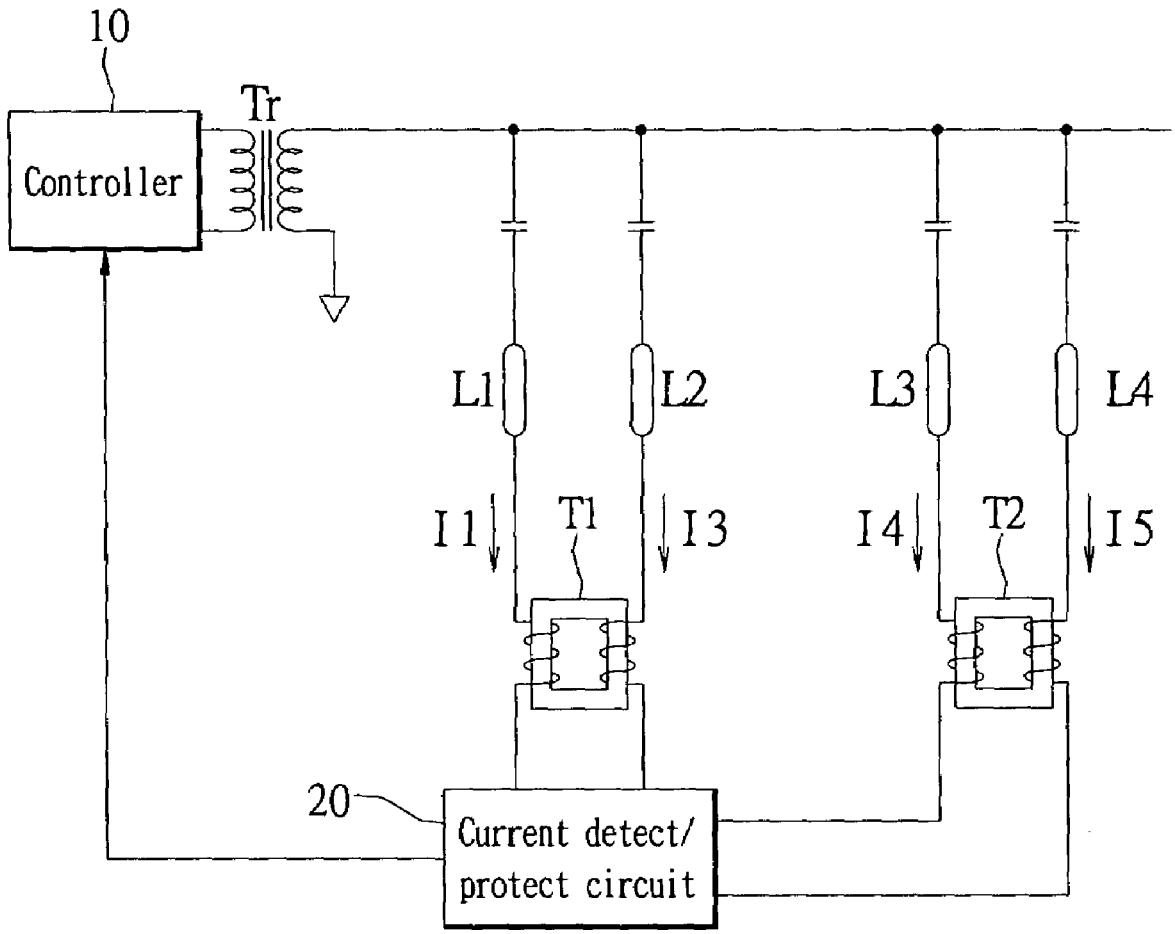
FIG. 1 PRIOR ART
FIG. 1 is a circuit diagram of a prior art adopting two balance transformers to balance the circuit of four cold cathode fluorescent lamps.
Figure 2:
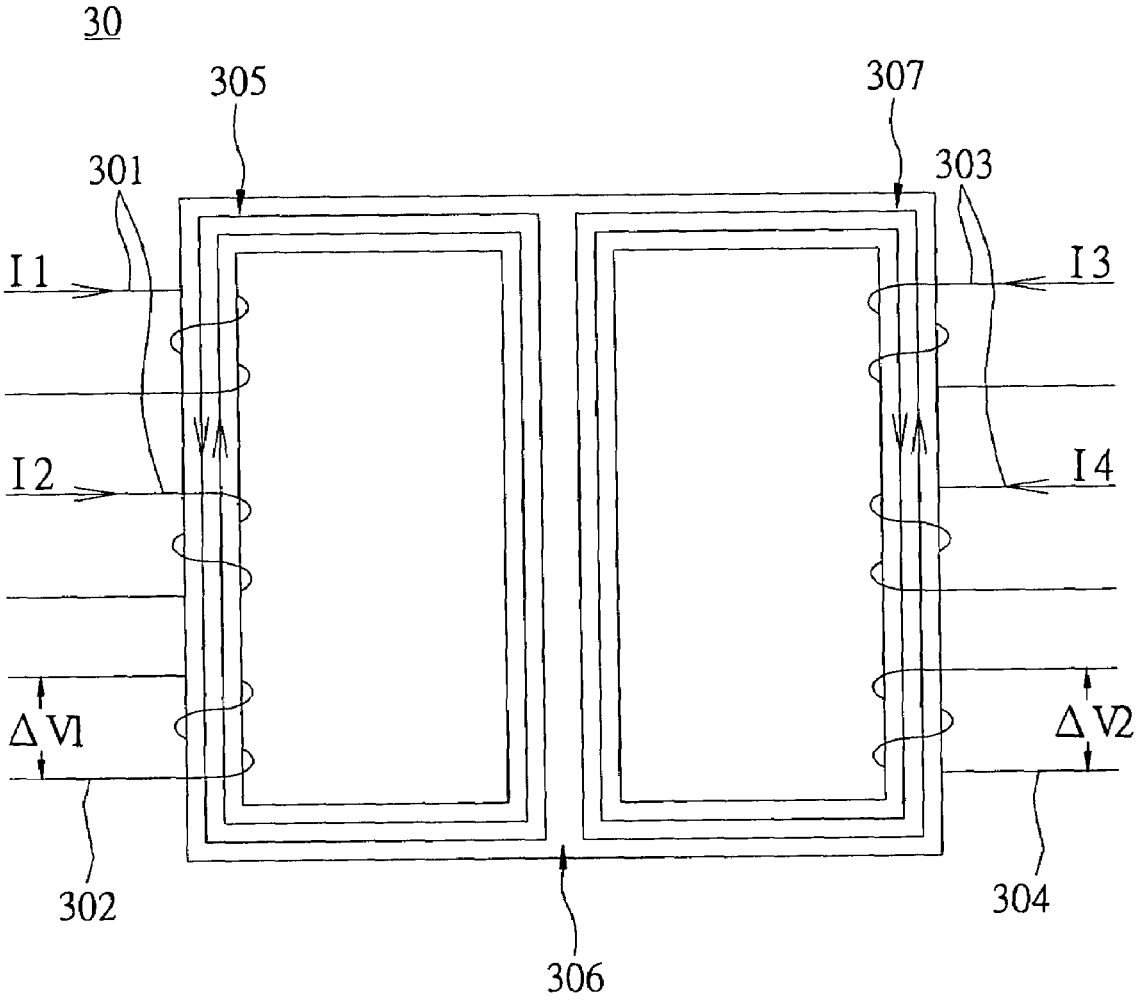
FIG. 2 a schematic circuit diagram of a multiple lamp balance transformer of the present invention.

Reference is made to FIG. 2 for the schematic circuit diagram of a multiple lamp balance transformer of the present invention. In FIG. 2, a multiple lamp balance transformer 30 comprises a magnetic core having a first side post 305, a second side post 307, and a middle post 306 disposed between the first side post 305 and the second side post 307. The middle post 306 is used to divide the first side post 305 and the second side post 307 into two, separate, closed magnetic flux paths. Two first coils 301 are wound around the first side post 305 in opposite directions; two second coils 303 are wound around the second side post 307 in opposite directions. The number of windings of the two first coils 301 is equal to that of the two second coils 303, and the impedance property of the coils and Lenz's Law are used to balance the operating currents I1, I2, I3, I4 passing through the lamps and the coils.

In the multiple lamp balance transformer 30 of the present invention, the two first coils 301 receive the operating currents I1, I2, respectively, while producing magnetic fluxes in opposite directions inside the first side post 305, and the two magnetic fluxes flow along the independent magnetic path of the closed magnetic flux produced by the middle post 306 and the first side post 305. If the operating currents I1, I2 are balanced, then the two magnetic fluxes will be equal in magnitude and opposite in direction. At that time, there is no magnetic flux on the closed magnetic flux path. If the currents I1, I2 are unbalanced, then magnetic fluxes will be produced on the closed magnetic flux path.

Similarly, in the multiple lamp balance transformer 30, the two second coils 303 receive the operating currents I3, I4, respectively, and the second side post 307 produces magnetic fluxes in opposite directions. The two magnetic fluxes flow along the independent magnetic path of the closed magnetic flux produced by the middle post 306 and the second side post 307. If the operating currents I3, I4 are balanced, then the two magnetic fluxes will be equal in magnitude and opposite in direction. At that time, there is no magnetic flux on the closed magnetic flux path. If the currents I3, I4 are unbalanced, then the magnetic fluxes will be produced on the closed magnetic flux path.

In view of the description above, the magnetic core is comprised of two E-shape magnetic cores, or one E-shape magnetic core and one I-shape magnetic core, or two n-shape magnetic cores and two L-shape magnetic cores. The two first coils 301 on the magnetic core are connected to a separate lamp (not shown in the figure) and receive the operating currents I1, I2 of the lamps. Mutually repulsive magnetic fluxes are produced in the first side post 305. Similarly, the two second coils 303 are connected to a separate lamp (not shown in the figure) and receive the operating currents I3, I4 of the lamps. Mutually repulsive magnetic fluxes are produced in the second side post 307. Further, the first side post 305 and the second side post 307 are further wound by a first auxiliary coil 302 and a second auxiliary coil 304. If the operating currents I1, I2, I3, I4 of the lamps are unbalanced, a first corrected voltage □V1 and a second corrected voltage □V2 will be induced.

Figure 3:
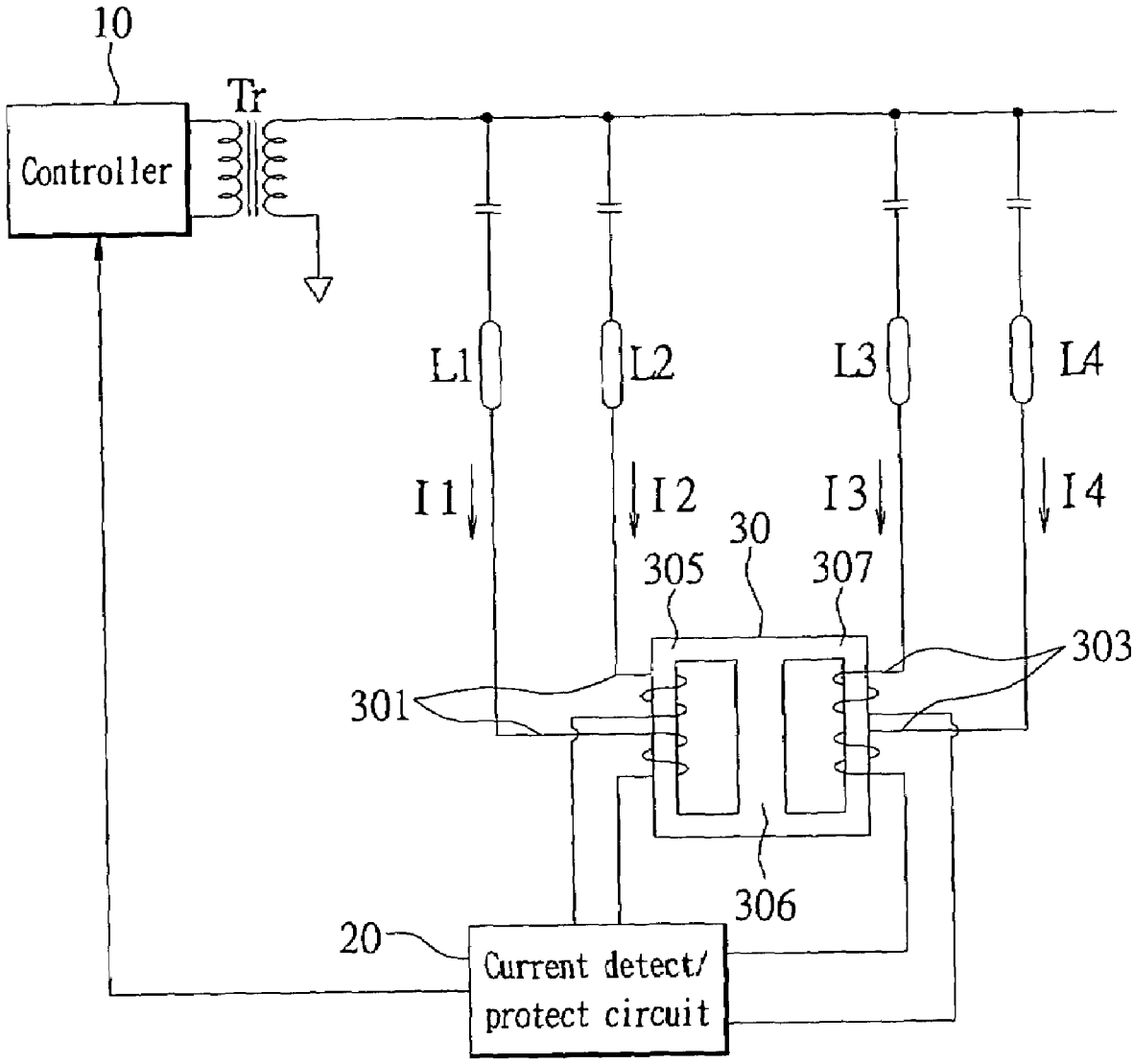
FIG. 3 is a schematic circuit diagram of a drive circuit adopting a multiple lamp balance transformer to balance the operating current of the lamps according to a first preferred embodiment of the present invention.

Reference is made to FIG. 3 for a schematic circuit diagram of a drive circuit adopting a multiple lamp balance transformer to balance the operating current of the lamps according to a first preferred embodiment of the present invention. In this embodiment, four lamps are used for description, but the invention is not limited to four lamps.

In the first preferred embodiment, the drive circuit of a multiple lamp balance transformer of the invention is coupled to a plurality of lamps L1, L2, L3, L4, comprising the following elements. A controller 10 supplies voltages and currents to the lamps 10 L1, L2, L3, L4 through a boost transformer Tr. A multiple lamp balance transformer 30 has the same structure and operating principle as illustrated in FIG. 2. Two first coils 301 and two second coils 303 on the multiple lamp balance transformer 30 are wound in opposite directions and connected respectively to the lamps L1, L2, L3, L4 for obtaining the operating currents I1, I2, I3, I4. A current detect/protect circuit 20 is connected separately to the two first coils 301, the two second coils 303 and the controller 10 for detecting the current passing through the two first coils 301 and the two second coils 303. The current detect/protect circuit 20 converts the operating currents of the lamps L1, L2, L3, L4 into the voltages I1, I2, I3, I4 to be sent to the controller 10, such that the controller 10 can control and supply sufficient voltages and currents I1, I2, I3, I4 for the use of the lamps L1, L2, L3, L4.

The drive circuit of the multiple lamp balance transformer of the invention uses the multiple lamp balance transformers having the same number of windings, and adopts the impedance property of the coils and Lenz's Law to balance the operating currents I1, I2, I3, I4 passing through the lamps L1, L2, L3, L4 and coils. At the same time, the two first coils 301 are connected to a separate lamp and receive the operating currents of the lamps, while mutually repulsive magnetic fluxes are produced in the closed magnetic flux paths produced by the first side post 305 and the middle post 306. The two second coils 303 are connected to a separate lamp and receive the operating currents of the lamps and mutually repulsive magnetic fluxes are produced in the closed magnetic flux paths produced by the second side post 307 and the middle post 306. The two closed magnetic flux paths separate the magnetic fluxes produced by the first coil 301 and the second coil 303 into independent magnetic flux circuits without interfering with each other, so as to achieve the effect of protecting the lamps.

Figure 4:
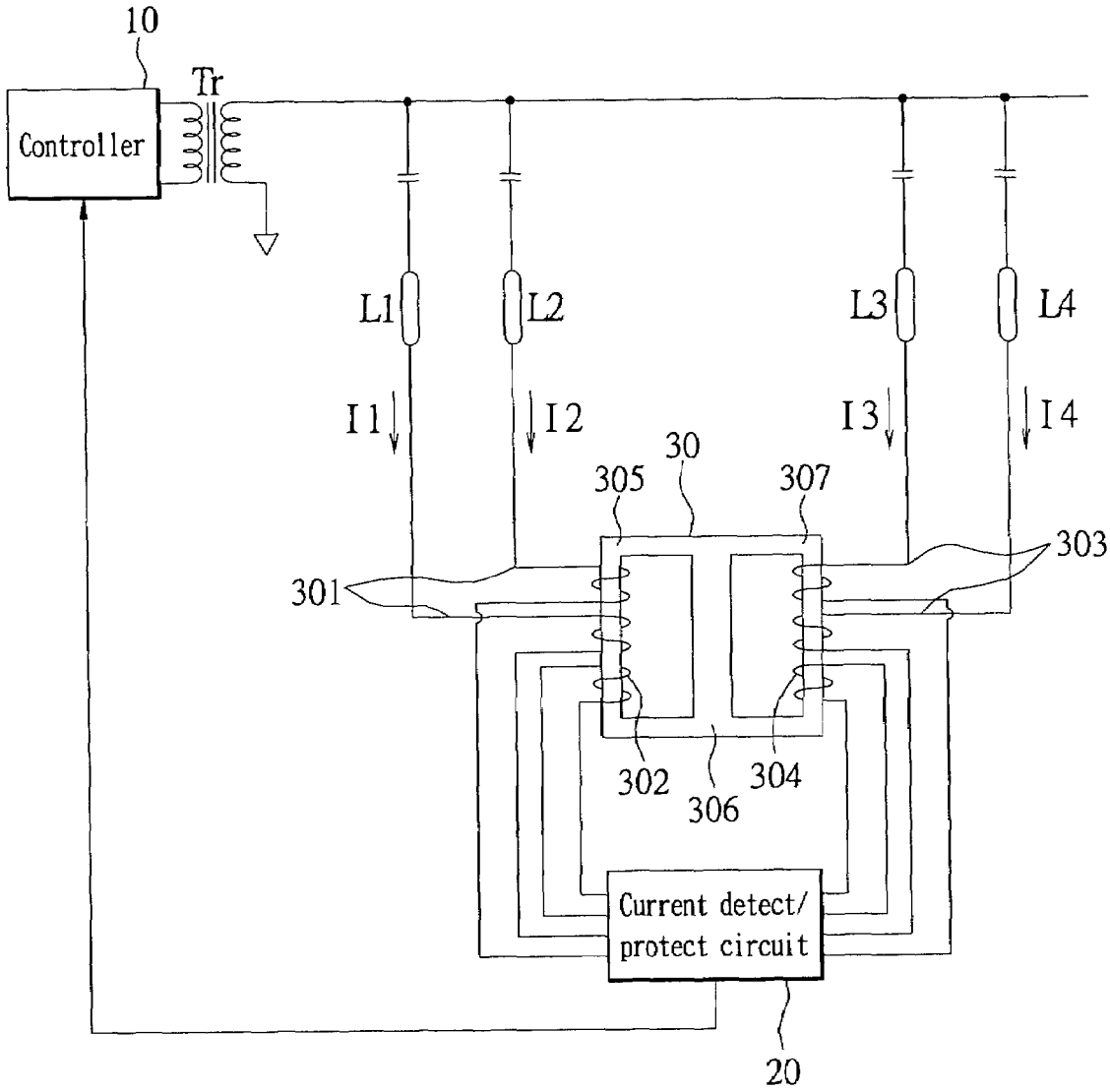
FIG. 4 is a schematic circuit diagram of a drive circuit adopting a multiple lamp balance transformer to balance the operating current of the lamps according to a second preferred embodiment of the present invention.

Reference is made to FIGS. 3 and 4 for the schematic circuit diagrams of a drive circuit adopting a multiple lamp balance transformer to balance the operating current of the lamps according to a second preferred embodiment. In this embodiment, four lamps are used for description of the principle of the drive circuit, but the invention is not limited to four lamps.

The difference between the second preferred embodiment and the first preferred embodiment resides in the second preferred embodiment further comprising a first auxiliary coil 302 wound around the first side post 305 and connected to the current detect/protect circuit 20 for inducing a first corrected voltage □V1 if the operating currents of the lamps are unbalanced, and sending the first corrected voltage □V1 to the current detect/protect circuit 20. The second preferred embodiment further comprises a second auxiliary coil 304 wound around the second side post 307 and connected to the current detect/protect circuit 20 for inducing a second corrected voltage □V2 if the operating currents of the lamps are unbalanced, and sending the second corrected voltage □V2 to the current detect/protect circuit 20.

The drive circuit of the multiple lamp balance transformer of the invention adopts the foregoing multiple lamp balance transformer 30 to connect a plurality of lamps L1, L2, L3, L4 while using a controller 10 to supply voltages and currents to the lamps L1, L2, L3, L4 through a boost transformer. A current detect/protect circuit 20 connected to the two first coils 301, the two second coils 303, the first auxiliary coil 302, the second auxiliary coil 304, and the controller 10 is used for detecting the currents I1, I2, I3, I4 passing through the two first coil 301*s*, the two second coils 303, the first corrected voltage □V1, and the second corrected voltage □V2. The current detect/protect circuit 20 converts the operating currents I1, I2, I3, I4 of the lamps L1, L2, L3, L4 into voltages to be sent to the controller 10, such that the controller 10 can control and supply sufficient voltage and current for the use of the lamps L1, L2, L3, L4 so as to protect the lamps, if the operating currents of the lamps are unbalanced.

Figure 5:
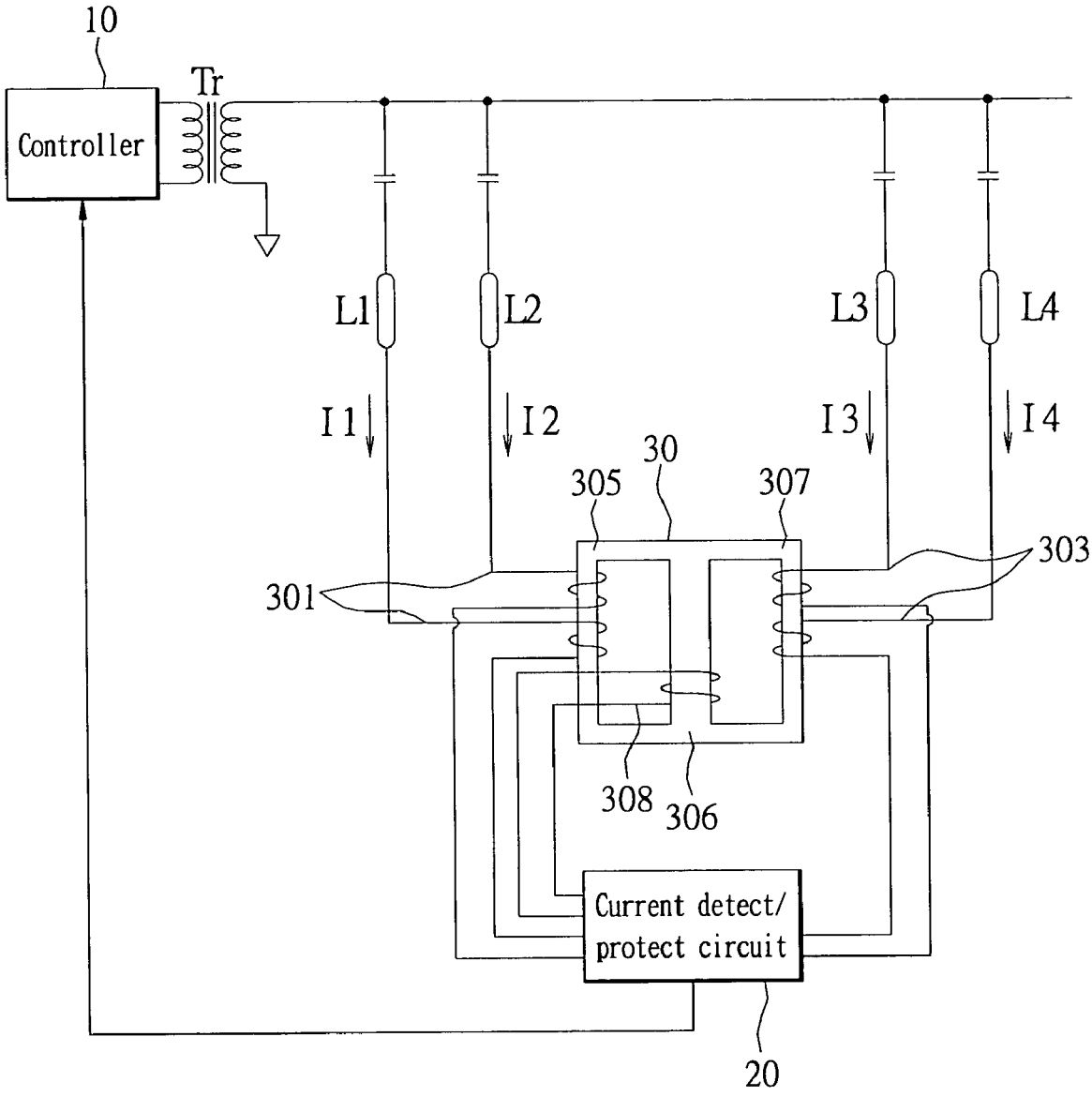
FIG. 5 is a schematic circuit diagram of a drive circuit adopting a multiple lamp balance transformer to balance the operating current of the lamps according to a third preferred embodiment of the present invention.

Reference is made to FIG. 5 together with FIG. 3 for the schematic circuit diagram of a drive circuit adopting a multiple lamp balance transformer to balance the operating current of the lamps according to a third preferred embodiment of the present invention. In this embodiment, four lamps are used for description of the principle of the drive circuit, but the invention is not limited to four lamps.

The difference between the third preferred embodiment and the first preferred embodiment resides in the third preferred embodiment further comprising a third auxiliary coil 308 wound around the middle post 306. The third auxiliary coil 308 is connected to the current detect/protect circuit 20 for inducing a third corrected voltage □V3 if the operating currents of the lamps are unbalanced, and sending the third corrected voltage □V3 to the current detect/protect circuit 20.

The drive circuit of the multiple lamp balance transformer of the invention adopts the foregoing multiple lamp balance transformer 30 to connect a plurality of lamps L1, L2, L3, L4 while using a controller 10 to supply voltage and current to the lamps L1, L2, L3, L4 through a boost transformer. A current detect/protect circuit 20 connected to the two first coils 301, the two second coils 303, the third auxiliary coil 308, and the controller 10 is used for detecting the currents I1, I2, I3, I4 passing through the two first coil 301*s* and the two second coils 303, and the third corrected voltage □V3.

The current detect/protect circuit 20 converts the operating currents I1, I2, I3, I4 of the lamps L1, L2, L3, L4 into voltages to be sent to the controller 10, such that the controller 10 can control and supply sufficient voltage and current for the use of the lamps L1, L2, L3, L4, so as to protect the lamps if the operating currents of the lamps are unbalanced.

Therefore, the drive circuit of the present invention adopts a multiple lamp balance transformer to drive simultaneously a plurality of lamps, so that the drive circuit is smaller than the prior arts, and features a lower cost by reducing the waste of manpower and working hours for the assembling so as to enhance its product competitiveness.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multiple lamp balance transformer, connected to a plurality of lamps for balancing operating currents of said lamps, comprising:

a magnetic core, having a first side post, a second side post, and a middle post, wherein the middle post is disposed between said first side post and said second side post, and said middle post forms two closed magnetic flux paths, respectively, with said first side post and said second side post;

two first coils, being wound around said first side post in opposite directions; and two second coils, being wound around said second side post in opposite directions;

wherein a number of windings of said two first coils is equal to a number of windings of said two second coils, and an impedance property of said coils is used for balancing the operating currents of said lamps and said coils.

2. The multiple lamp balance transformer of claim 1, wherein said two first coils coupled to a separate lamp receive the operating current of said lamps and produce mutually repulsive magnetic fluxes in said first side post.

3. The multiple lamp balance transformer of claim 1, wherein said two second coil coupled to a separate lamp receive the operating current of said lamps and produce mutually repulsive magnetic fluxes in said first side post.

4. The multiple lamp balance transformer of claim 1, wherein said magnetic core is comprised of two E-shape magnetic cores.

5. The multiple lamp balance transformer of claim 1, wherein said magnetic core is comprised of an E-shape magnetic core and an I-shape magnetic core.

6. The multiple lamp balance transformer of claim 1, wherein said magnetic core is comprised of two n-shaped magnetic cores and two L-shape magnetic cores.

7. The multiple lamp balance transformer of claim 1, further comprising a first auxiliary coil wound around said first side post for inducing a first corrected voltage if the operating currents of said lamps are unbalanced.

8. The multiple lamp balance transformer of claim 1, further comprising a second auxiliary coil wound around said second side post for inducing a second corrected voltage if the operating currents of said lamps are unbalanced.

9. The multiple lamp balance transformer of claim 1, further comprising a third auxiliary coil wound around said middle post for inducing a third corrected voltage if the operating currents of said lamps are unbalanced.

10. A drive circuit of a multiple lamp balance transformer, coupled to a plurality of lamps, and comprising:

a controller, for supplying a current to said lamps through a boost transformer;

a multiple lamp balance transformer, including a first side post, a second side post, and a middle post, wherein the middle post is disposed between said first side post and said second side post, two first coils are wound around said first side post in opposite directions, two second coils are wound around said second side post in opposite directions, and said middle post forms two closed magnetic flux paths, respectively, with said first side post and said second side post; and a current detect/protect circuit, separately coupled to said two first coils, said two second coils, and said controller for detecting current passing through said two first coils and said two second coil;

wherein said current detect/protect circuit sends the operating currents of said lamps to said controller, such that said controller controls and supplies a balanced current for use of said lamps.

11. The drive circuit of a multiple lamp balance transformer of claim 10, wherein said two first coils and said two second coils have an equal number of windings.

12. The drive circuit of a multiple lamp balance transformer of claim 10, wherein said two first coils are coupled to a separate lamp and receive the operating currents of said lamps, and produce mutually repulsive magnetic fluxes in closed magnetic flux paths produced by said first side post and said middle post.

13. The drive circuit of a multiple lamp balance transformer of claim 10, wherein said two second coils are coupled to a separate lamp and receive the operating currents of said lamps, and produce mutually repulsive magnetic fluxes in the closed magnetic flux paths produced by said second side post and said middle post.

14. The drive circuit of a multiple lamp balance transformer of claim 10, wherein said magnetic core is comprised of two E-shape magnetic cores.

15. The drive circuit of a multiple lamp balance transformer of claim 10, wherein said magnetic core comprises an E-shape magnetic core and an I-shape magnetic core.

16. The drive circuit of a multiple lamp balance transformer of claim 10, wherein said magnetic core is comprised of two n-shape magnetic cores and two L-shape magnetic cores.

17. The drive circuit of a multiple lamp balance transformer of claim 10, further comprising a first auxiliary coil wound around said first side post and coupled to said current detect/protect circuit for inducing a first corrected voltage if said lamps are operating abnormally and the currents are unbalanced, and sending said first corrected voltage to said current detect/protect circuit.

18. The drive circuit of a multiple lamp balance transformer of claim 10, further comprising a second auxiliary coil wound around said second side post and coupled to said current detect/protect circuit for inducing a second corrected voltage if said lamps are operating abnormally and the currents are unbalanced, and sending said second corrected voltage to said current detect/protect circuit.

19. The drive circuit of a multiple lamp balance transformer of claim 10, further comprising a third auxiliary coil wound around said middle post and coupled to said current detect/protect circuit for inducing a third corrected voltage if said lamps are operating abnormally and the currents are unbalanced, and sending said third corrected voltage to said current detect/protect circuit.

* * * * *